US007201835B2

(12) United States Patent
Puetter et al.

(10) Patent No.: US 7,201,835 B2
(45) Date of Patent: Apr. 10, 2007

(54) METHOD FOR PRODUCING ORTHOCARBOXYLIC ACID TRIALKYL ESTERS

(75) Inventors: Hermann Puetter, Neustadt (DE); Andreas Fischer, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 242 days.

(21) Appl. No.: 10/489,257

(22) PCT Filed: Sep. 5, 2002

(86) PCT No.: PCT/EP02/09926

§ 371 (c)(1),
(2), (4) Date: Mar. 11, 2004

(87) PCT Pub. No.: WO03/027357

PCT Pub. Date: Apr. 3, 2003

(65) Prior Publication Data

US 2004/0245115 A1 Dec. 9, 2004

(30) Foreign Application Priority Data

Sep. 21, 2001 (DE) ..... 101 46 566

(51) Int. Cl.
*C25B 3/00* (2006.01)

(52) U.S. Cl. ..... 205/455; 205/422; 205/423; 205/426; 205/427

(58) Field of Classification Search ..... 205/455, 205/422, 423, 426, 427
See application file for complete search history.

(56) References Cited

U.S. PATENT DOCUMENTS 4,699,698 A * 10/1987 Degner et al. ..... 205/422

FOREIGN PATENT DOCUMENTS

DE 3000243 7/1981
DE 3000243 A * 7/1981
WO 0220446 3/2002
WO 0242524 5/2002

* cited by examiner

*Primary Examiner*—Edna Wong
(74) *Attorney, Agent, or Firm*—Oblon, Spivak, McClelland, Maier & Neustadt, P.C.

(57) ABSTRACT

A process for the preparation of orthoesters of the general formula I,

I

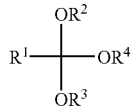

where the radicals have the following meaning
$R^1$: hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkylalkyl or $C_4$- to $C_{10}$-aryl
$R^2$, $R^3$: $C_1$- to $C_{20}$-alkyl, $C_3$- to $C_{12}$-cycloalkyl, and $C_4$- to $C_{20}$-cycloalkylalkyl or $R^2$ and $R^3$ together form $C_2$- to $C_{10}$-alkylene
$R^4$: $C_1$- to $C_4$-alkyl,
by electrochemically oxidizing a compound of the general formula II

II

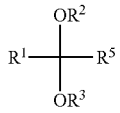

in which the radicals $R^1$ to $R^3$ have the same meaning as in the general formula I and
$R^5$ is a saturated or unsaturated 5- or 6-membered heterocycloalkyl radical or heterocycloaryl radical having up to 2 heteroatoms selected from the group consisting of N, O and S, where this radical is bonded to the remaining part of the molecule via a carbon atom which is situated in the adjacent position to a heteroatom,
in the presence of $C_1$- to $C_4$-alcohols (alcohols A).

10 Claims, No Drawings

METHOD FOR PRODUCING ORTHOCARBOXYLIC ACID TRIALKYL ESTERS

The invention relates to a process for the preparation of orthoesters of the general formula I

I

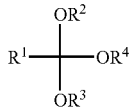

where the radicals have the following meaning $R^1$: hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkylalkyl or $C_4$- to $C_{10}$-aryl $R^2$, $R^3$: $C_1$- to $C_{20}$-alkyl, $C_3$- to $C_{12}$-cycloalkyl, and $C_4$- to $C_{20}$-cycloalkylalkyl or $R^2$ and $R^3$ together form $C_2$- to $C_{10}$-alkylene $R^4$: $C_1$- to $C_4$-alkyl, by electrochemically oxidizing a compound of the general formula II

II

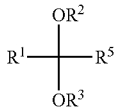

in which the radicals $R^1$ to $R^3$ have the same meaning as in the general formula I and $R^5$ is a saturated or unsaturated 5- or 6-membered heterocycloalkyl radical or heterocycloaryl radical having up to 2 heteroatoms selected from the group consisting of N, O and S, where this radical is bonded to the remaining part of the molecule via a carbon atom which is situated in the adjacent position to a heteroatom, in the presence of $C_1$–$C_4$-alcohols (alcohols A).

Nonelectrochemical processes for the preparation of trialkyl orthocarboxylates such as trimethylorthoformate (TMOF) are known, or example, from DE-A-3606472, chloroform being reacted together with sodium methoxide.

The preparation of TMOF from hydrocyanic acid and methanol is furthermore known in J. Org. Chem. 20 (1955) 1573.

From J. Amer. Chem. Soc., (1975) 2546 and J. Org. Chem., 61 (1996) 3256 and Electrochim. Acta 42, (1997) 1933 electrochemical processes are known with which C—C single bonding between C atoms which each carry an alkoxy function can be oxidatively cleaved. Specific formation of orthoester functions, however, is not described.

From Russ. Chem. Bull., 48 (1999) 2093, it is known to decompose vicinal diketones, which are present in the form of their acetals, by anodic oxidation using high amounts of charge and in the presence of a high excess of methanol (cf. p. 2097, 1$^{st}$ column, 5$^{th}$ paragraph) into the corresponding dimethyl dicarboxylate.

In Canadian Journal of Chemistry, 50 (1972) 3424, the anodic oxidation of benzil tetramethyl diketal to trimethyl orthobenzoate in a more than 100-fold excess of methanol is described. According to the authors, the products yield, however, is only 62% and the current yield 5%.

In Journ. Am. Chem. Soc., (1963), 2525, the electrochemical oxidation of the orthoquinone tetramethyl ketal in a basic methanol solution to the corresponding orthoester is described. The reaction was carried out in a basic methanol solution, the substrate concentration being 10%. The product yield was 77% at a current yield of 6% (16 F/mol). It was hitherto not possible to prepare purely aliphatic orthoesters in an electrochemical manner.

In the previously unpublished DE-A-10059304, a process for the preparation of trialkyl orthocarboxylates (orthoester O) by electrochemical oxidation of alpha, beta-diketones or alpha, beta-hydroxyketones in the presence of $C_1$- to $C_4$-alcohols is described, the keto function being present in the form of a ketal function derived from $C_1$- to $C_4$-alkylalcohols and the hydroxyl function optionally being present in the form of an ether function derived from $C_1$- to $C_4$-alkylalcohols. The invention relates in particular to the preparation of trimethyl orthoformate from the corresponding methyl acetals and methanol.

The object on which the invention is based thus consisted in making available an electrochemical process in order to make trialkylorthocarboxylates, in particular trimethylorthoformate (TMOF) accessible economically and in particular in high current and product yields and with high selectivity.

The process described at the outset has accordingly been found.

Preferably, the compounds of the general formula I can be prepared by the process according to the invention from those compounds of the general formula II in which the radical $R^5$ is pyrrol-2-yl, furan-2-yl, thiophen-2-yl, tetrahydrofuran-2-yl, pyridin-2-yl, pydridin-3-yl, pyridin-4-yl, imidazol-2-yl, imidazol-4-yl, 4,5-dehydroimidazol-2-yl, 4,5-dehydroimidazol-4-yl, oxazol-2-yl, oxazol-4-yl, oxazol-5-yl, thiazol-2-yl, thiazol-4-yl or thiazol-5-yl. These heterocyclic radicals can carry up to 2 substituents selected from the following group: $C_1$- to $C_{20}$-alkyl, $C_3$- to $C_{12}$-cycloalkyl, $C_4$- to $C_{20}$-cycloalkylalkyl, $C_4$- to $C_{10}$-aryl, amino, mono-$C_1$- to $C_{20}$-alkylamino or di-$C_1$- to $C_{20}$-alkylamino, hydroxyl, $C_1$- to $C_{20}$-mercapto. Preferably, however, they are unsubstituted.

These substituents can be situated either on a C atom or, in the case of the imidazolyl radicals, an N atom of the heterocyclic ring.

In general, those compounds of the general formula I are prepared in which the radicals $R^2$ and $R^3$ have the same meaning. Preferably, the alcohol A or the compound of the general formula II is chosen such that the radicals $R^2$, $R^3$ and $R^4$ have the same meaning.

Particularly preferably, those compounds of the general formula I are prepared in which the radicals $R^2$, $R^3$ and $R^4$ are methyl. Correspondingly, the alcohol A chosen is methanol and the compound of the general formula II chosen is one in which the radicals $R^2$ and $R^3$ have the meaning methyl.

Very particularly preferably, trimethylorthoformate (TMOF) is prepared according to the invention, the compound of the general formula II employed being furfuraldimethylacetal and the alcohol A employed being methanol.

In the electrolyte, the alcohols A and the compound of the general formula II are in general employed in equimolar amounts or alcohol A is employed in an excess and then serves simultaneously as a solvent or diluent for the compound of the general formula II and the compound of the general formula I formed.

If appropriate, customary cosolvents are added to the electrolysis solution. These are the inert solvents having a high oxidation potential generally customary in organic chemistry. Dimethyl carbonate or propylene carbonate may be mentioned by way of example.

Conducting salts which are contained in the electrolysis solution are in general alkali metal, tetra($C_1$- to $C_6$-alkyl) ammonium, preferably tri($C_1$- to $C_6$-alkyl)methylammonium, salts. A suitable counterion is sulfate, hydrogensulfate, alkylsulfates, arylsulfates, halides, phosphates, carbonates, alkylphosphates, alkylcarbonates, nitrate, alcoholates, tetrafluoroborate or perchlorate.

The acids derived from the abovementioned anions are furthermore suitable as conducting salts.

Methyltributylammonium methylsulfates (MTBS) methyltriethylammonium methylsulfate or methyl-tri-propylmethylammonium methylsulfates are preferred.

The process according to the invention can be carried out in all customary types of electrolysis cell. Preferably, the process is carried out continuously using undivided flow-through cells.

Very particularly suitable are bipolarly connected capillary gap cells or plates stack cells in which the electrodes are shaped as plates and are arranged plane-parallel (cf. Ullmann's Encyclopedia of Industrial Chemistry, 1999 electronic release, Sixth Edition, VCH-Verlag Weinheim, Volume Electrochemistry, Chapter 3.5. special cell designs and Chapter 5, Organic Electrochemistry, Subchapter 5.4.3.2 Cell Design).

When the process is carried out continuously, the supply rate of the substances employed is in general chosen such that the weight ratio of the compounds of the general formula II employed to the compounds of the general formula I formed in the electrolytes is 10:1 to 0.05:1.

The current densities at which the process is carried out are in general 1 to 1000, preferably 10 to 100, mA/cm$^2$. The temperatures are customarily −20 to 60° C., preferably 0 to 60° C. In general, the process is carried out at normal pressure. Higher pressures are preferably used if the process is to be carried out at higher temperatures in order to avoid boiling of the starting compounds and/or cosolvents.

Suitable anode materials are, for example, noble metals such as platinum or metal oxides such as ruthenium or chromium oxide or mixed oxides of the type $RuO_xTiO_x$. Graphite or carbon electrodes are preferred.

Suitable cathode materials are, for example, iron, steel, stainless steel, nickel or noble metals such as platinum and graphite or carbon materials. The system graphite as an anode and cathode and graphite as an anode and nickel, stainless steel or steel as a cathode is preferred.

After completion of the reaction, the electrolysis solution is worked up according to general separation methods. For this, the electrolysis solution is in general first distilled and the individual compounds are recovered separately in the form of different fractions. A further purification can be carried out, for example, by crystallization, distillation or chromatographically.

EXPERIMENTAL SECTION

An undivided plates stack cell having graphite electrodes in a bipolar arrangement was employed. 75 g of furfuraldimethylacetal (94% strength, prepared from furfural and trimethylorthoformate), 80 g of methanol and 1.7 g of ammonium tetrafluoroborate were reacted at a temperature of 20° C. The electrolysis was carried out at 300 A/m$^2$ and an amount of charge of 2 F based on the furfural was passed through the cells. 5.7 GC area % of trimethylorthoformate was obtained in the electrolysis discharge.

We claim:

1. A process for the preparation of orthoesters of formula I,

I

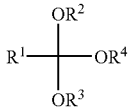

where the radicals have the following meaning $R^1$: hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$- cycloalkylalkyl or $C_4$- to $C_{10}$-aryl $R^2$, $R^3$: $C_1$- to $C_{20}$-alkyl, $C_3$- to $C_{12}$-cycloalkyl, and $C_4$- to $C_{20}$-cycloalkylalkyl or $R^2$ and $R^3$ together form $C_2$- to $C_{10}$-alkylene $R^4$: $C_1$- to $C_4$-alkyl, by electrochemically oxidizing a compound of formula II

II

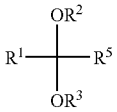

in which the radicals $R^1$ to $R^3$ have the same meaning as in formula I, and $R^5$ is a saturated or unsaturated 5- or 6-membered heterocycloalkyl radical or heterocycloaryl radical having up to 2 heteroatoms selected from the group consisting of N, O and S, where this radical is bonded to the remaining part of the molecule via a carbon atom which is situated in the adjacent position to a heteroatom, in the presence of one or more alcohols A of formula $R^4$—OH, where $R^4$ is defined as above.

2. A process as claimed in claim 1, where the compound of the formula II employed is one in which the radical $R^5$ is pyrrol-2-yl, furan-2-yl, thiophen-2-yl, tetrahydrofuran-2-yl, pyridin-2-yl, pyridin-3-yl, pyridin-4-yl, imidazol-2-yl, imidazol-4-yl, 4,5-dehydroimidazol-2-yl, 4,5-dehydroimidazol-4-yl, oxazol-2-yl, oxazol-4-yl, oxazol-5-yl, thiazol-2-yl, thiazol-4-yl or thiazol-5-yl.

3. A process as claimed in claim 1, wherein the compound of the formula II employed is one in which the radical $R^5$ is unsubstituted or comprises up to 2 substituents selected from the following group: $C_1$- to $C_{20}$-alkyl, $C_3$- to $C_{12}$-cycloalkyl, $C_4$- to $C_{20}$-cycloalkylalkyl, $C_4$- to $C_{10}$-aryl, amino, mono-$C_1$- to $C_{20}$-alkylamino or di- $C_1$- to $C_{20}$-alkylamino, hydroxyl or, $C_1$- to $C_{20}$-mercapto.

4. A process as claimed in claim 1, wherein the compound of the formula II employed is one in which the radical $R^1$ is hydrogen and the radicals $R^2$ and $R^3$ are methyl and the alcohol A employed is methanol.

5. A process as claimed in claim 1, wherein the compound of the formula II employed is furfural dimethyl acetal and the alcohol A employed is methanol.

6. A process as claimed in claim 1, wherein the electrochemical oxidizing is carried out in an electrolyte which, as a conducting salt, contains tetra($C_1$- to $C_6$-alkyl)ammonium salts with sulfate, hydrogensulfate, alkylsulfates, arylsulfates, halides, phosphates, carbonates, alkylphosphates, alkylcarbonates, nitrates, alcoholates, tetrafluoroborate or perchlorate as a counterion.

7. A process as claimed in claim 1, wherein the electrochemical oxidizing is carried out in an undivided electrolysis cell.

8. A process as claimed in claim 1, wherein the electrochemical oxidizing is carried out in a bipolarly connected capillary gap cell or plate stack cell.

9. A process for the preparation of trimethyl orthoformate comprising:

I)—preparing furfural dimethyl acetal by acetalyzing furfural with methanol in the presence of a protonic acid as catalyst; and II)—preparing trimethyl orthoformate by electrochemical oxidation of the furfural dimethyl acetal prepared according to the preparing in I.

10. A process as claimed in claim 9, wherein the electrochemical oxidizing is carried out in a bipolarly connected capillary gap cell or plate stack cell.

* * * * *